US006435088B2

(12) United States Patent
Fujimoto

(10) Patent No.: US 6,435,088 B2
(45) Date of Patent: Aug. 20, 2002

(54) SHEET GUIDE UNIT FOR SHEET-FED PRESS

(75) Inventor: Shinichi Fujimoto, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/777,658

(22) Filed: Feb. 7, 2001

(30) Foreign Application Priority Data

Feb. 8, 2000 (JP) ..... 2000-030855

(51) Int. Cl.[7] ..... B41F 13/00; B41F 21/00; B65H 29/24

(52) U.S. Cl. ..... 101/232; 101/217

(58) Field of Search ..... 101/136, 141, 101/142, 177, 217, 232; 271/195

(56) References Cited

U.S. PATENT DOCUMENTS 4,384,524 A * 5/1983 Simeth et al. ..... 101/232
5,687,964 A * 11/1997 Stephan et al. ..... 271/195
5,816,155 A * 10/1998 Gunter ..... 101/232
5,931,093 A * 8/1999 Walther et al. ..... 101/232
6,135,026 A * 10/2000 Kalbanthner et al. ..... 101/232

FOREIGN PATENT DOCUMENTS

JP 10-109404 4/1998

* cited by examiner

*Primary Examiner*—Daniel J. Colilla
(74) *Attorney, Agent, or Firm*—Crowell & Moring LLP

(57) ABSTRACT

A sheet guide unit for a sheet-fed press which will prevent the sheet from flapping or fluttering, and allow sheets of thinner paper to be conveyed smoothly even when using a skeleton cylinder, The sheet guide unit is provided under an intermediate cylinder or a delivery cylinder, and has a curved sheet guide surface with which the lower surface of the cylinder creates a small sheet guide space, the space through which an air stream is directed. An air supply chamber and a pair of air aspiration chambers are provided for directing air through the sheet guide space. An air guide fin which is an outer extended portion of the curved sheet guide surface directs the air from the sheet guide into the aspiration chambers.

6 Claims, 6 Drawing Sheets

SHEET GUIDE UNIT FOR SHEET-FED PRESS

BACKGROUND OF THE INVENTION

1. Field of the invention

This invention concerns a sheet-fed press in which the sheet being fed is stabilized. More specifically, it concerns a sheet guide unit in the sheet-fed press. The sheet guide unit with a curved sheet guide surface is provided under the intermediate cylinder or the delivery cylinder, and it is separated from those cylinders by a small sheet guide space which serves as a guide for feeding the sheet.

2. Description of the Related Art

Multiple-color sheet-fed presses which employ a series of printers each of which prints a different color ink are well known in the prior art. As can be seen in FIG. 5, the basic structural elements of such presses are feeder unit A, which consists of feeder device 39; printer unit B, which has four printers, 132*a*, 132*b*, 132*c* and 132*d*, arrayed in tandem to print cyan, magenta, yellow and black; and delivery unit C, here paper delivery unit 04.

In multiple-color sheet-fed presses with this configuration, a sucker unit with an inlet for sheets 11, which are piled on table 141 of the feed unit 39, separates a single sheet and transports it on conveyor 120. Swing gripper 121*a* delivers the sheet to intermediate cylinder 121*b* of printer 132*a*. The sheet is fed between blanket cylinder 22*a* and impression cylinder 23*a*, and the first color is printed.

Once the first color has been printed, the sheet is fed out between the blanket cylinder 22*a* and impression cylinder 23*a* and taken up by intermediate cylinder 27*a* of the second printer 132*b*. From the intermediate cylinder 27*a*, the sheet is delivered to impression cylinder 23*b*. The next process, the printing of the second color, is executed by blanket cylinder 22*b* and impression cylinder 23*b*.

The subsequent colors are printed one after the other. When sheet 11 is fed out between blanket cylinder 22*d* and impression cylinder 23*d*, which perform the final-stage printing, it is pulled onto delivery cylinder 35 of delivery unit C. From delivery cylinder 35, the now completely printed sheet 11 is taken onto chain conveyor 124 and transported to delivery unit 04, where it is added to the stack on table 40 of the unit 04.

Generally, the sheets 11 which are printed in *a* sheet-fed press are of a thickness which ranges from 0.04 m/m to 0.8 m/m. At times, high-rigidity sheets of metal plate or synthetic resin might also be printed. As the sheet is fed from printer 132*a* to printer 132*b* to print the various colors, various mishaps may occur. A thin sheet of paper will generally have low rigidity, and its rear portion will tend to flap. A thicker sheet of paper or sheet metal will have high rigidity, and its reaction force (stability) against the centrifugal force of rotation and its own curvature will cause its rear portion to separate from impression cylinder 23, and collide with the sheet guide unit 1 below the cylinder resulting a paper rebounding.

When the paper flaps or rebounds in this way, the print may be smudged or the paper folded or torn. This phenomenon is a significant cause of a reduction in print quality. Two typical methods employed to counteract this problem are to use a skeleton cylinder or a drum cylinder for the intermediate cylinder 27. This allows the most appropriate scheme to be used for the rigidity of whatever sheet is being printed.

The example shown in FIG. 6(A) is a skeleton-type intermediate cylinder 27, which is used primarily when printing thicker sheets of paper. One of these skeleton cylinders 27 is placed on each side of each printer 132. Each skeleton cylinder consists of a pair of rotors (arms) 271 which rotate on axis 270. Each arm 271 has a series of pawls 29 on its shaft 272 (see FIG. 7(A)) running from the end of arm 271 to the end of arm 271 on the opposite side of the shaft. The distinguishing feature of the skeleton cylinder 27 is that the area of the cylinder which comes in contact with impression cylinder 23 when the paper passes between them is extremely small. The sheet 100 which is being rotated forward is allowed to bend beyond point P where it comes into contact with pawls 29. In other words, the point of contact P becomes the point of action. By lengthening the distance from this point to the end of sheet 100, we reduce the reactive force exerted by the sheet in its attempt to return to its original shape.

As a result, we reduce the amount of rebounding at the end of the sheet which strikes sheet guide unit 1', the curved guide which conforms to the hypothetical circumference of the lower portion of skeleton-type intermediate cylinder 27. This scheme minimizes tears and folds; but on the other hand, because this sort of skeleton cylinder 27 provides a larger region in which the end of sheet 100 is free, a thin sheet will have more opportunity to flap.

The example shown in FIG. 6(B) is drum cylinder-type intermediate cylinder 27', which is used primarily for thinner sheets of paper. This sort of drum cylinder 27' has a number of pawls 29 in two places along the circumference of a roller which rotates on axis 270.

The feature which distinguishes drum cylinder 27' is that the amount of its surface area which comes in contact with impression cylinder 23 as sheet 100 is fed between them is maximized. Because the portion of sheet 100 which is beyond pawls 29 is guided along the circumference of the drum cylinder (27'), this scheme makes it very difficult for the end of the sheet to flap, so it minimizes doubling, tearing and other defects resulting from the end of the sheet wrinkling or flapping. However, when this sort of drum cylinder 27' is used to convey thicker varieties of paper, the fact that there is very little area where the end of the sheet is free will result in significant rebounding.

In recent years, as print quality has improved, there has been a tendency to use the skeleton cylinders even for thinner papers. To keep thin sheets from flapping, a sheet guide unit 1 is provided which has a sheet guide surface 1*d* following the contour of the lower portion of intermediate cylinder 27 (or 27') and delivery unit 35 (hereafter referred to as the intermediate cylinder). In order to address the problems in this sort of sheet-fed press, a sheet guide unit is provided in which specifically pressurized air is blown through a number of vents in the sheet guide unit into the space between intermediate cylinder 27 and surface 1*d* of the sheet guide unit. This air is blown along the bottom of sheet 11 as it passes through the space along sheet guide surface 1*d*. Because of the Bernoulli effect, the air blown through the vents causes the sheet 11 to be suspended.

One such sheet guide unit is described in Japanese Patent Publication (Kokai) Hei 10-109404. We shall explain the relevant technology with reference to FIG. 7. The sheet guide unit, which runs along the circumference of skeleton-type intermediate cylinder 27 or delivery cylinder 35, both of which are studded with pawls 29, consists of air ducts 06. On the upper surface of the air ducts 06 are numerous air vents 4*a* and 4*b*. The vents 4*a* and 4*b* face in opposite directions and are located on either side of the center of the intermediate cylinder 27 or of delivery cylinder 35. The vents distribute the air toward the outer edges of the intermediate cylinder 27. The vents 4*a* and 4*b* produce two streams of air which originate at the vents and continue to move in the directions determined by the vents. These air streams keep the sheet of paper suspended at a specified height, thus stabilizing the travel of the sheet.

In the prior art technique, then, air is blown through a space between sheet guide surface id and the intermediate cylinder underneath sheet 11. The sheet is caught on pawls 29 of skeleton-type intermediate cylinder 27, the type of cylinder used for thicker papers. The air is blown into the space from ducts 06 below the guide surface through the air vents 4*a* and 4*b*. More specifically, as can be seen in FIG. 7(B), streams of air are blown toward both sides of intermediate cylinder 27 through vents which face away from each other on either side of the middle of the cylinder 27. These streams of air create a difference in the rate of the airflow above and below the sheet, thus producing the Bernoulli effect. The sheet 11 which is being conveyed along the surface of the intermediate cylinder 27 is drawn toward surface 1*d* of the sheet guide unit and suspended slightly above it as it is conveyed, before being taken up by the next impression cylinder 23.

This sheet guide unit has an aspiration duct 3' which exhausts at the outlet end of guide surface 1*d*. On either side of guide surface 1*d* of duct 2' are air vents 4*a* and 4*b*. The aspiration duct 3' is connected to duct 2', which is in the interior of the unit, via fans 51.

Because the duct 3' is provided on the outlet end of the guide surface, the air which is blown across the width of the sheet along surface 1*d* of the sheet guide unit will be drawn into aspiration duct 3' by the action of fans 51. The air directed by fans 51 is drawn into aspiration duct 3' and redirected by duct 2' toward vents 4*a* and 4*b*.

However, the prior art technology suffers from the following problems.

In the sheet guide unit 1', aspiration duct 3' and duct 2' are connected, so the volume of air driven by fans 51 and the volume drawn into the aspiration duct must be equal. However, if the same volume of air is drawn into the aspiration duct, not all of the air flowing over surface 1*d* of the sheet guide unit can be drawn in. More specifically, the sheet guide unity 1' is mounted inside two sets of frames 011, which support the cylinders of the sheet-fed press. From the aspiration duct 3', the excess air will end up escaping into the press mechanism. Some of the air blown out through vents 4, in other words, will not be drawn into the duct. After the air is used to draw sheet 11 toward the sheet guide unit, this air will collide with frame 011 and cause undesirable turbulence in the press mechanism. If a thinner paper is being printed, this may cause its lateral edges to flutter.

To address this problem, the prior art design shown in FIG. 8 isolates aspiration ducts 3' and propulsion ducts 2' by interposing partitions 52. Instead of a fan, it employs a pump 13' to drive a larger volume of air.

However, with this configuration, the volume of air propelled by the pump and the volume aspirated will still be equal, just as in FIG. 7. With this prior art design, the air stream propelled from the nozzle of the guide surface will be moving at a high velocity (approximately 20 to 30 m/s), so it will have a high inertial force. Below the nozzle, a turbulent boundary layer will begin to form, and the flow itself will become thicker and move away from the surface of the sheet guide unit.

With this prior art design, then, the recovery of the air flow from both sides of the sheet guide unit into the chamber provided on each side will be inefficient. The unrecovered air will collide with the frame, causing turbulence within the frame of the press mechanism. This turbulence will disrupt the flow in the upstream segment of the sheet guide space. If a thinner stock is being printed, the end of the sheet is very likely to flap or flutter. If the intermediate cylinder is a skeleton cylinder, conveying a thinner paper becomes extremely problematic.

SUMMARY OF THE INVENTION

In view of these problems in the prior art, the object of this invention is to provide a sheet guide unit for a sheet-fed press which prevent the sheet from flapping or fluttering, and would allow sheets of thinner paper to be conveyed smoothly even when a skeleton cylinder, which is better suited to thicker papers. The sheet guide unit according to this invention has a sheet guide space in which a sheet can pass. The sheet guide space is provided between a printing cylinder and a sheet guide unit. Air is blown through vents on the sheet guide unit into the sheet guide space. The sheet guide unit for such a press can prevent the air streams flowing through the sheet guide space and exiting from both ends of the sheet guide unit from colliding with the frame and causing turbulence.

To solve this object, the sheet guide unit according to this invention is configured as follows. This sheet guide unit is provided below a printing cylinder, such as an intermediate cylinder and a delivery cylinder of sheet-fed press, below which is fashioned a curved sheet guide surface separated by a small sheet guide space. The sheet guide unit has air supply chambers which are behind the sheet guide surface, and numerous air vents which vent air from the air supply chambers into the sheet guide space. The air vents face away from each other toward the sides of the cylinder on either side of its center line. They vent air along the surface of the sheet guide unit along the width of the cylinder. The difference in the velocity of the air flow above and below the sheet being conveyed by the rotation of the cylinder then causes the sheet to be drawn toward the surface of the sheet guide unit and suspended slightly above it as it is conveyed.

The sheet guide unit is characterized by the following configuration. At least a pair of air aspiration chambers would be provided adjacent to the air supply chambers on the outer sides of the cylinder at the outlets of the sheet guide unit. The outlet ends of the sheet guide surface would be extended, and the extended portions would lead into the air aspiration chambers so that they could serve as guide fins to direct the air into the chambers. The volume of air drawn into the aspiration chambers on either side of the cylinder would be larger than the volume of air blown into the aspiration chambers. This would create a negative pressure in the vicinity of the ends of the sheet guide surface.

The actual design of the guide fin should be as follows. Its cross section should form an angle $\alpha$ of 20 to 40° with respect to the sheet guide surface of the sheet guide unit. Ideally, it should be a straight fin set at an angle $\alpha$ a of approximately 30°. Alternatively, the fin may have a curved cross section so that its curved surface leads into the aspiration chamber.

The specific relationship between the volume of air blown into the chambers and the volume drawn into the chambers should be as follows. Exhaust. pumps should be connected to the aspiration chambers, and supply pumps should be connected to the supply chambers. These may be regulated so that the volume of air exhausted by the exhaust pumps is larger than the volume supplied by the supply pumps.

Alternatively, recirculation paths may be created by installing recirculation pumps between the aspiration and supply chambers. In this case, escape valves should be provided between the outlets of the recirculation pumps and the air supply chambers to allow a portion of the air to escape from the recirculation paths.

With this invention, then, a negative pressure is created on the outlet ends of the sheet guide unit on both sides of the printing cylinder. The ends of the sheet guide unit are extended, and the extended portions lead into the air aspiration chambers so that they can serve as fins to direct the air into the chambers. Thus even when the air stream flowing along the surface of the sheet guide unit is moving at a high velocity, all of the air directed to the outlets of the sheet guide unit will flow along the guide fins and be drawn into the chambers.

As a result, the air stream flowing through the sheet guide space cannot overflow and collide with the frame, causing thinner papers to flap. In other words, this scheme allows us to minimize turbulence in the air stream throughout the entire sheet guide space. Even when a skeleton cylinder is used, thinner papers can be conveyed without problems.

The air is sucked efficiently into the aspiration chambers; and the negative pressure at the ends of the sheet guide unit has the effect of reducing the thickness of the boundary layer on the sheet guide surface of the sheet guide unit near the ends of the guide. This prevents eddies from forming, thus making it easier to draw the sheet toward the surface of the sheet guide unit when a thinner paper is being printed. It will prevent thinner papers from flapping or buckling.

With this invention, then, the effect of the negative pressure and the guide fins prevent eddies from forming at the ends of the sheet guide surface. This insures that the flow of air through the entire sheet guide space will be virtually free of turbulence. The turbulent boundary layer under the sheet due to the air stream will be thinner, so the sheet is less likely to flap or flutter, but will be conveyed smoothly through the sheet guide space.

So simply by adding guide fins and increasing the volume of air drawn into a pair of chambers, i.e., through a simple and inexpensive design, we can prevent thinner sheets from flapping or buckling when a skeleton cylinder is used and enable them to be conveyed smoothly.

Because the guide fins have the particular configuration described above, the air stream will flow along the surface of the fins without hindrance. The flow is less likely to burble from the surface of the guide, and turbulence in the sheet guide space will be kept to a minimum, thus stabilizing the flow.

The negative pressure at the ends of the guide has the effect of suppressing the formation of a turbulent boundary layer over the sheet guide unit. The layer which does form will be thinner, and the flow will be more stable. The Bernoulli effect will be maximized in the sheet guide space, allowing the sheet to be conveyed more smoothly. Although the same effect may be obtained by connecting a number of independent pumps of different capacities, it may also be obtained by installing an escape valve to exhaust a portion of the air on the forward side of the pump which recirculates air along the path between the aspiration and supply chambers. Since the latter scheme can be implemented using only one recirculation pump, it would reduce the cost of equipment to choose this option.

By adjusting the escape valve, we can control both the rate of flow and the pressure of the air flowing through the recirculation pipe. This valve makes it easy to adjust the Bernoulli effect in the sheet guide space.

DETAILED DESCRIPTION OF THE PREFERRED EMBODIMENTS

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
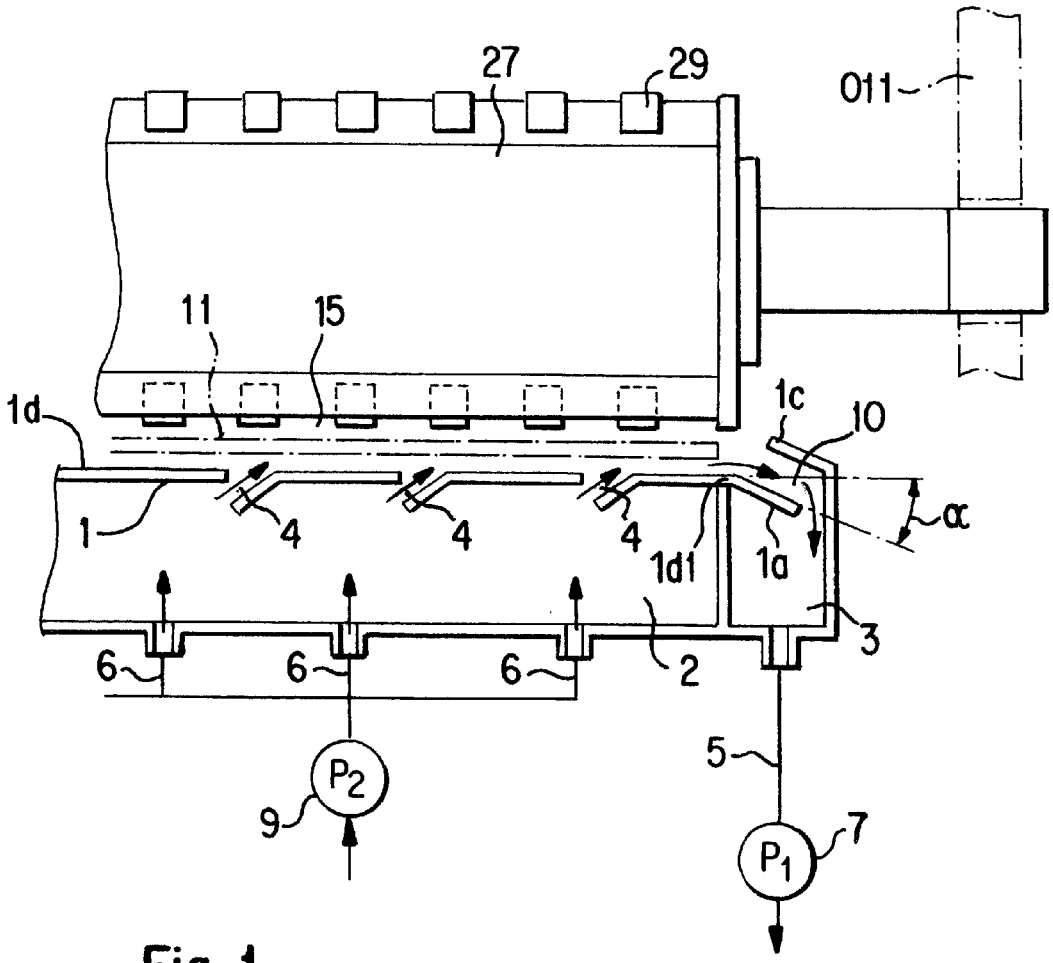
FIG. 1 is a cross section of the essential parts of a sheet guide unit and its environs. This sheet guide unit is installed in a sheet-fed press which is the first preferred embodiment of this invention. The cross section is viewed from arrow A—A in FIG. 5.
Figure 2:
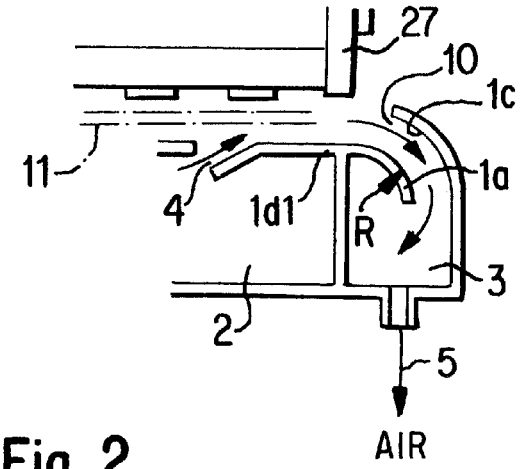
FIG. 2 is a cross section of the essential parts of the end of the sheet guide unit given as the second preferred embodiment.
Figure 3:
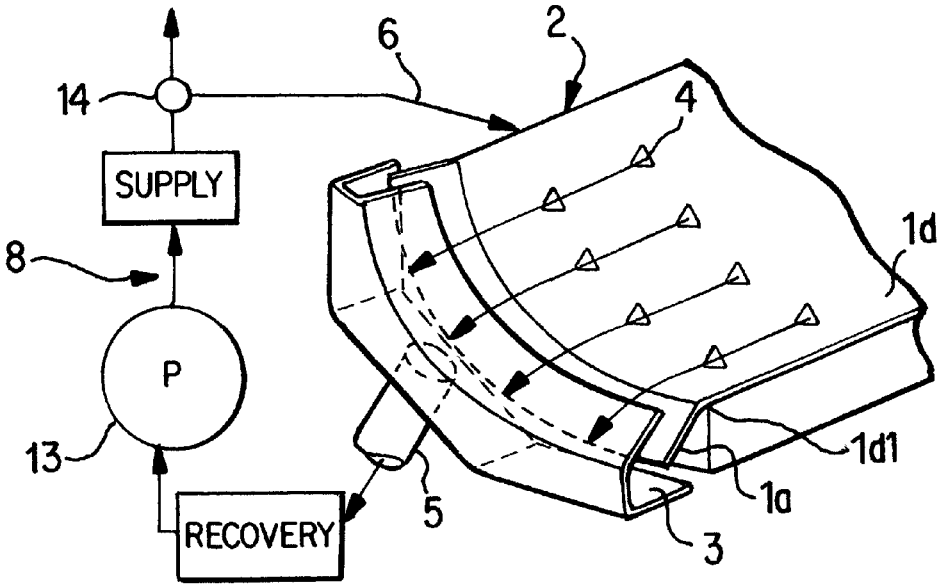
FIG. 3 is a perspective drawing of the essential parts of the third preferred embodiment.
Figure 4:
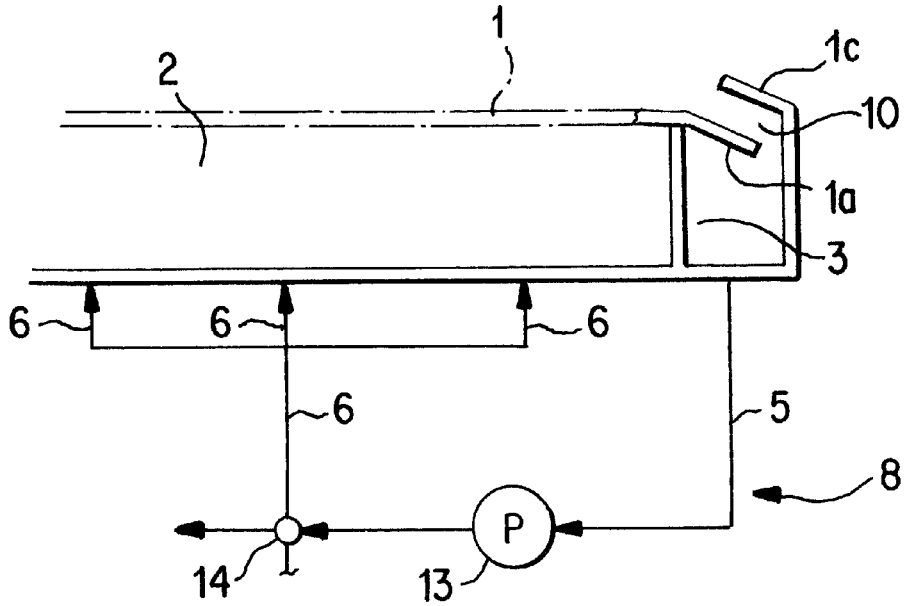
FIG. 4 shows the air system in FIG. 3.
Figure 5:
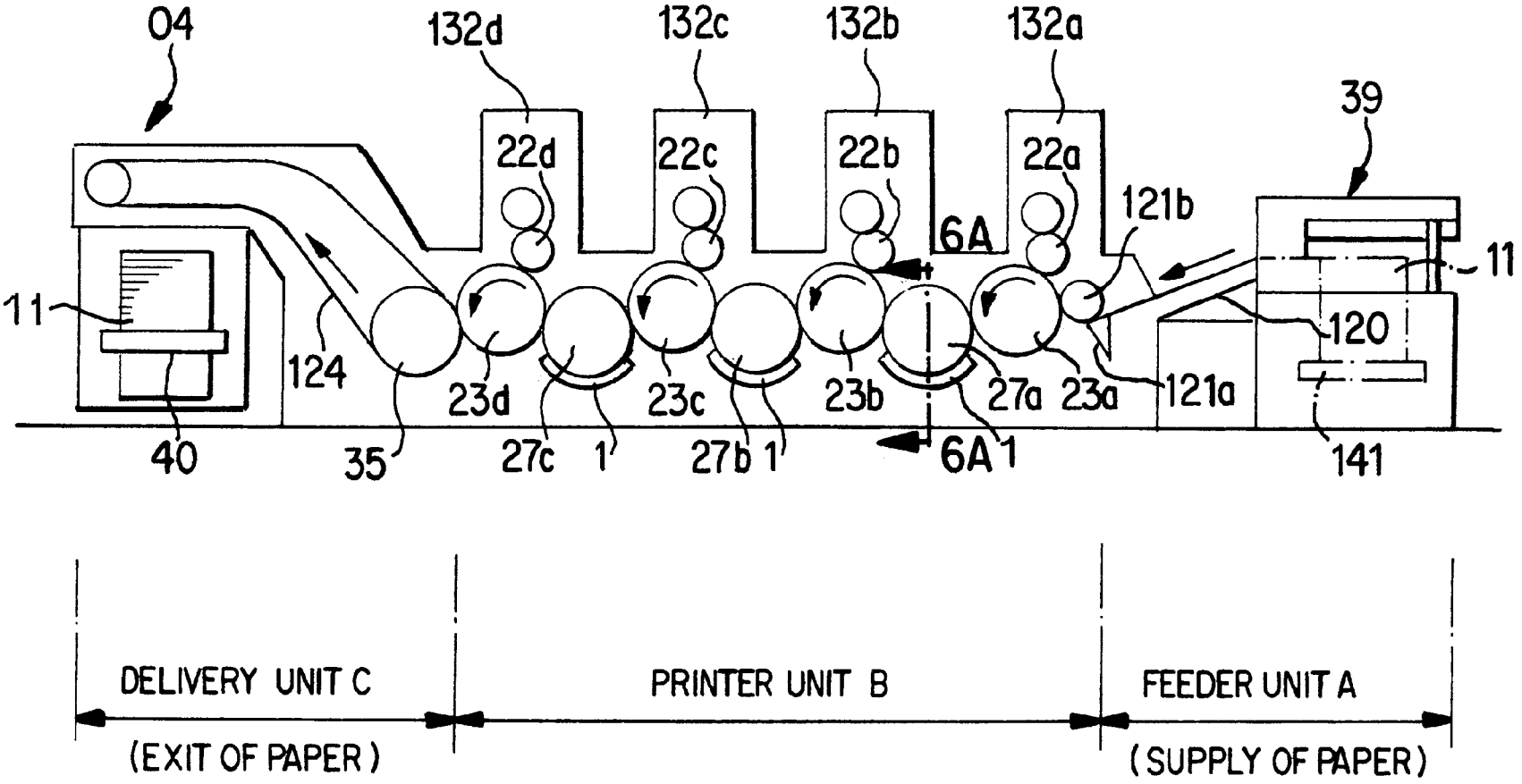
Fig. 5 PRIOR ART
FIG. 5 shows the overall configuration of a sheet-fed press in which the present invention is implemented.
Figure 6A:
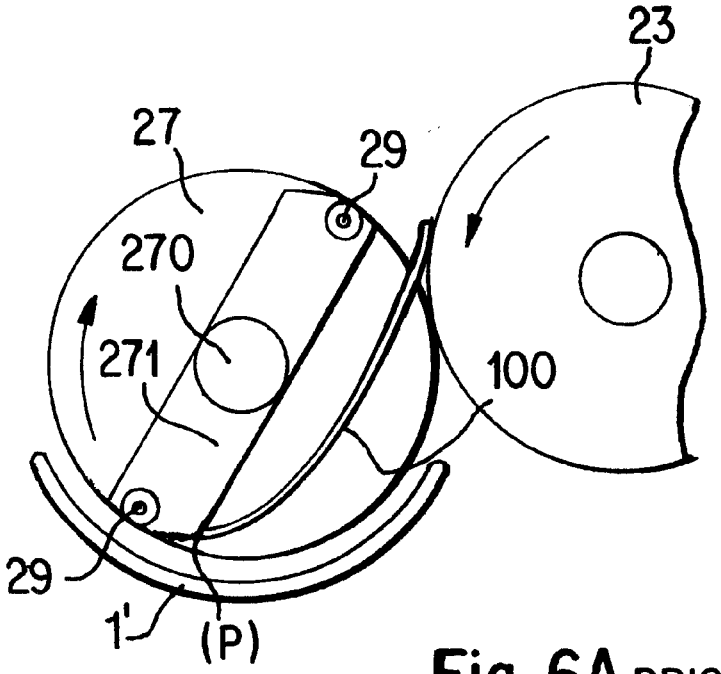
Fig. 6A PRIOR ART
FIG. 6 shows the two types of intermediate cylinders in use. (A) is a skeleton cylinder and (B) is a drum cylinder.
Figure 6B:
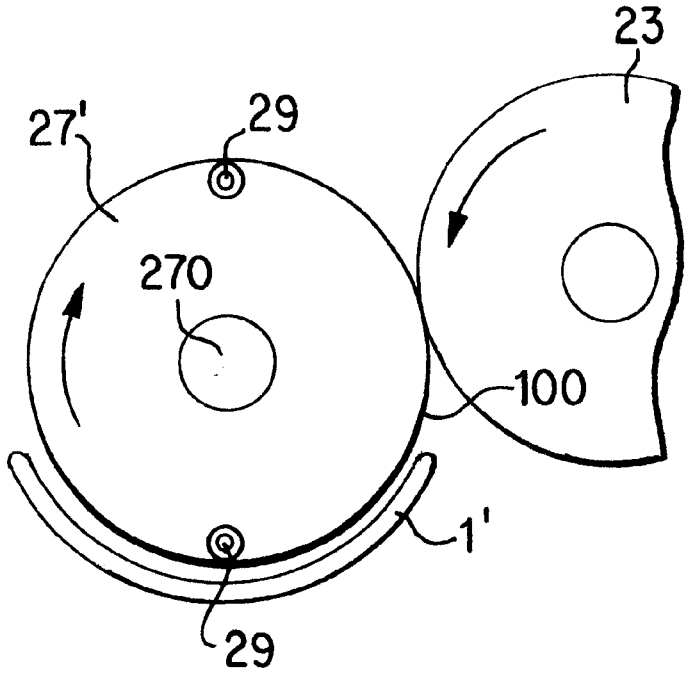
Fig. 6B PRIOR ART

FIG. 1 is a cross section of the essential parts of a sheet guide unit and its environs. This sheet guide unit is installed in a sheet-fed press which is the first preferred embodiment of this invention. (The cross section is viewed from arrow A—A in FIG. 5.) FIG. 2 is a cross section of the essential parts of the end of the sheet guide unit given as the second preferred embodiment. FIG. 3 is a perspective drawing of the essential parts of the third preferred embodiment. FIG. 4 shows the air system in FIG. 3.

These embodiments all concern sheet guide unit 1, whose surface 1*d* conforms to the circumference of the lower portion of intermediate cylinder 27 and delivery cylinder 35 (hereafter both referred to as intermediate cylinders). In these embodiments, a skeleton cylinder is used as the intermediate cylinder. 29 are the pawls arrayed lengthwise along the skeleton-type intermediate cylinder 27 which grab sheet 11. 011 is the frame which supports the ends of the skeleton cylinder 27 in such a way that it can rotate freely.

Figure 7A:
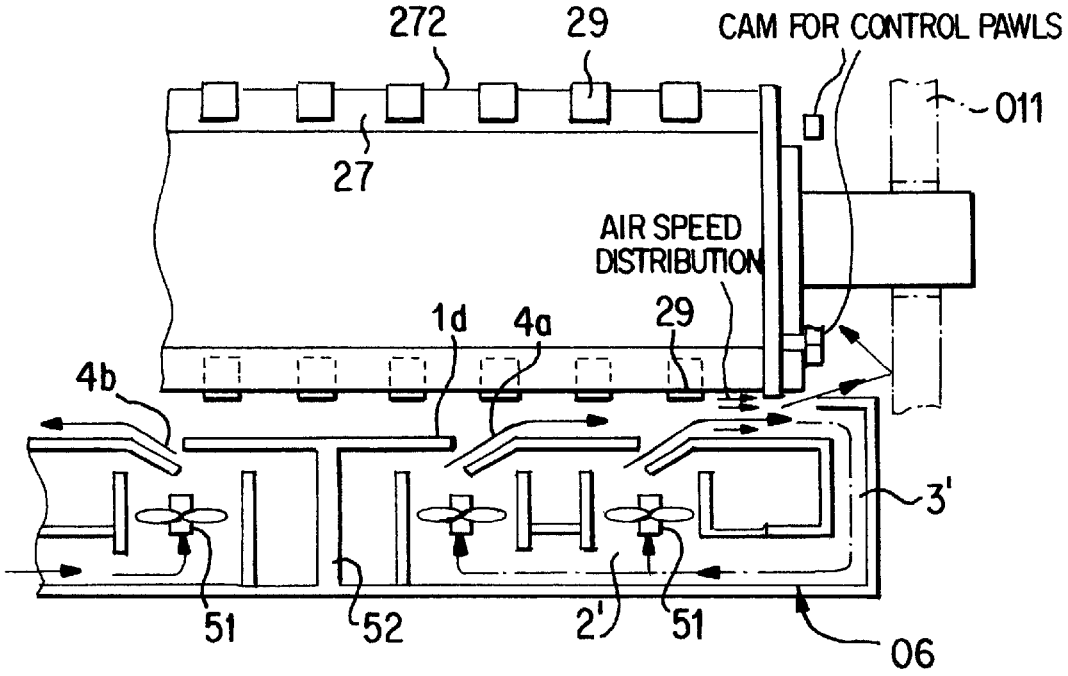
Fig. 7A PRIOR ART
FIG. 7 shows the essential configuration of a prior art design. (A) is a frontal cross section showing the configuration of the area around the skeleton-type intermediate cylinder and the sheet guide unit installed along its circumference. (B) shows the surface of the sheet guide unit.
Figure 7B:
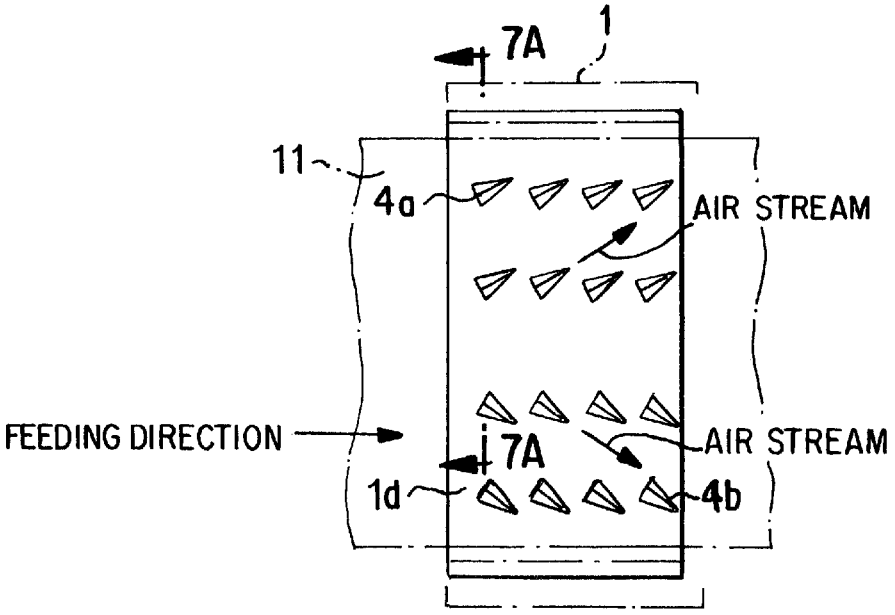
Fig. 7B PRIOR ART
Figure 8:
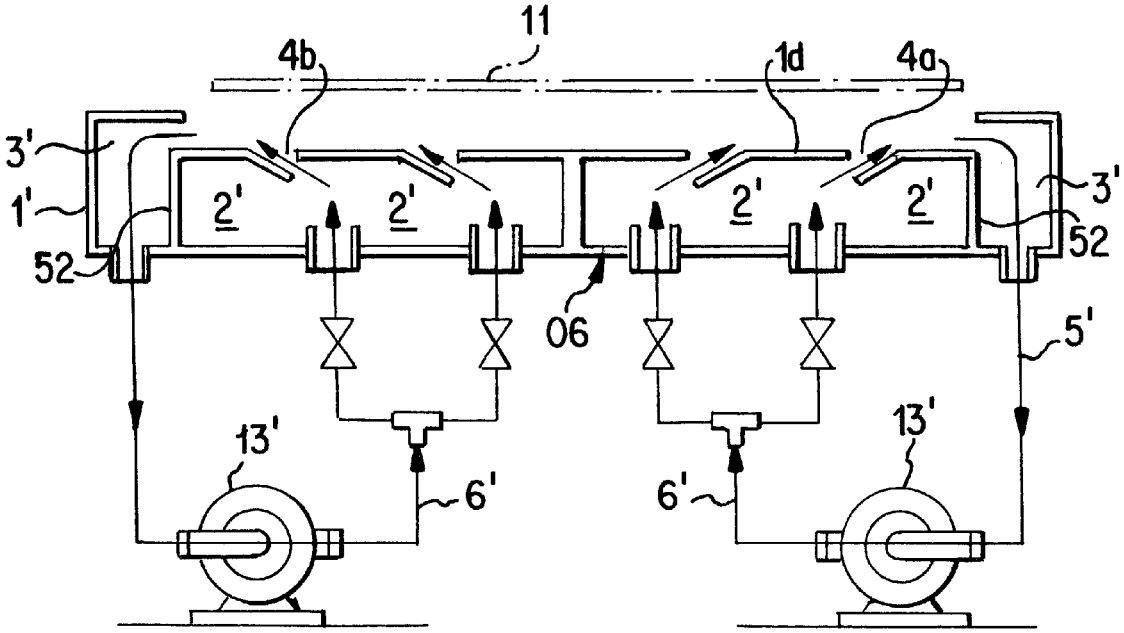
Fig. 8 PRIOR ART
FIG. 8 shows the essential parts of another prior art design. It is a frontal cross section of the area around the skeleton-type intermediate cylinder and the sheet guide unit installed along its circumference.

As was discussed previously, sheet guide unit 1 has a curved surface id with which the lower surface of the intermediate cylinder 27 creates sheet guide space 15, the space through which the air stream is directed. Behind the surface 1*d* of the sheet guide unit and occupying virtually the entire length of the space below it is a single air supply chamber 2 or two such chambers, one on either side of a partition. 4 are the air vents which are provided in surface 1*d* of the sheet guide unit. As can be seen in FIG. 7(B), these vents allow the sheet guide space 15 to communicate with the air supply chamber 2. They face away from each other on either side of the center line of the intermediate cylinder 27. The vents are distributed in two arrays which face the ends of the intermediate cylinder 27. From the air vents 4, two streams of air are propelled in the directions in which the vents are aimed. These streams maintain the sheet in the appropriate position and stabilize its travel.

Below the sheet 11 which is caught by pawls 29 of skeleton-type intermediate cylinder 27, a stream of air is blown through sheet guide space 15. This space, which has an air supply chamber 2 below it, is between surface 1*d* of the sheet guide unit and intermediate cylinder 27. The air stream is blown along surface 1*d* of the sheet guide unit through vents 4 on the left and right, either parallel to the surface or angled slightly upward, so that it flows along the bottom of the sheet. The difference in the velocity of the air flow above and below the sheet causes the Bernoulli effect to occur. The sheet 11 being conveyed on the surface of the intermediate cylinder 27 is drawn toward surface 1*d* of the sheet guide unit and suspended slightly above it as it is conveyed. The arrangement and orientation of the multiple air vents 4 are not limited to those pictured in FIG. 7(B), but may be selected as needed.

6 is a supply pipe connected to the air supply chamber 2. 9 is the supply pump on the air supply pipe 6.

The air supply chamber 2 extends across virtually the entire length of surface 1*d* of the sheet guide unit, which corresponds to the axial length of skeleton cylinder 27. It is located under the sheet guide surface. It contains two independent aspiration chambers 3 to the left and right which are separated from the air supply chamber 2 by a partition. These aspiration chambers 3, which can be seen in FIG. 3, describe an arc in the direction of the sheet's travel, and are of an equal length with the air supply chamber 2.

The inlet of each aspiration chamber 3 (aspiration channel 10) is formed by upper wall 1*c*, which comes quite close to the peripheral surface of intermediate cylinder 27 on the top of sheet guide space 15. It is placed in this location so that it can efficiently capture the air stream which is flowing along the sheet guide unit and the lower surface of the sheet 11. The lower surface of the inlet (i.e., of aspiration channel 10) consists of surface 1*a*, an extension of the end 1*d*1 of surface 1*d* of the sheet guide unit. The surface 1*a* extends downward into the aspiration chamber 3 and functions as guide fin 1*a* (see FIG. 3), the fin which extends all the way across surface 1*d* of the sheet guide unit.

In cross section, the guide fin 1*a* slants down into the aspiration chamber 3 at an angle $\alpha$ with respect to the end 1*d*1 of surface 1*d* of the sheet guide unit. The angle $\alpha$ a should be between 20 and 40°, ideally in the neighborhood of 30°.

Exhaust pump 7 is connected to the aspiration chamber 3 via exhaust pipe 5. Supply pump 9, which supplies air uniformly to the supply chamber 2, is connected to that chamber via branching pipe 6. The exhaust pump 7 has a greater capacity to exhaust air than the supply pump 9 has to supply air.

We shall next explain the operation of a sheet guide unit 1 in a sheet-fed press configured as above.

A thin sheet 11 handed off by the previous impression cylinder 23 is caught by pawls 29 of the skeleton cylinder 27. The sheet passes through sheet guide space 15, which is between the skeleton cylinder 27 and the sheet guide unit 1.

Via the supply pipe 6, the pump 9 supplies to the chamber 2 air which has been pressurized to a given value and fills the entire chamber. The uniformly pressurized air in the chamber 2 is propelled along through sheet guide space 15 between surface 1*d* of the sheet guide unit and intermediate cylinder 27. It is blown out through the vents 4 as shown in FIG. 7(B). These vents face away from each other on either side of the intermediate cylinder 27 and are aimed toward the sides of the cylinder. The resulting difference in the flow velocity above and below the sheet creates a Bernoulli effect. The sheet 11 being conveyed along the surface of the intermediate cylinder 27 is drawn toward surface 1*d* of the sheet guide unit and suspended slightly above it as it is conveyed. As the skeleton cylinder 27 rotates, the sheet passes through the sheet guide space 15.

The air which passes through the sheet guide space 15, as indicated by the arrows in FIG. 1, enter aspiration channel 10 between the guide fin 1*a* and upper wall 1*c* of aspiration chamber 3, and thereby enters the chamber 3.

Because the exhaust pump 7 has a greater capacity than the supply pump 9, the force with which the air from sheet guide space 15 is drawn through aspiration channel 10 and out of aspiration chamber 3 will be greater than that which filled the supply chamber 2. This will increase the magnitude of the Bernoulli effect in sheet guide space 15, thus insuring that the sheet is conveyed smoothly, particularly around the inlet of chamber 3. The fact that the volume of air drawn into chamber 3 is greater than that blown into chamber 2 means that the outlet end 1*d* of the sheet guide unit, which is the inlet to aspiration chamber 3, will be at negative pressure. This will prevent eddies from forming in the vicinity of the end of the sheet guide unit. A stable laminar flow can be achieved so that the sheet 11 being conveyed will be less liable to flap or flutter.

The outlet end 1*d*1 of surface 1*a* of the sheet guide unit extends into aspiration chamber 3 so as to serve as the guide fin 1*a*. Thus the air which flows out of the sheet guide space 15 is directed by the guide fin 1*a* into aspiration channel 10. In addition to the effect of the negative pressure at the outlet end 1*d*1, the guide fin 1*a* also causes the air blown through the space to flow into aspiration chamber 3. The air which flows past the lateral edges of sheet 11 is safely recovered in aspiration chamber 3, rather than bouncing off frame 011. This scheme eliminates turbulence on the sides of the sheet, and it allows the layer of air over sheet guide unit 1 to be drawn into aspiration chamber 3, thus preventing adverse effects which would result if eddies were present.

Experiments conducted by the inventors have suggested that when the angle $\alpha$ of the guide fin 1*a* exceeds 30°, the air stream which is directed into the aspiration chamber 3 will begin to burble off the surface of the guide fin 1*a* and form eddies, generating turbulence in the air stream in the sheet guide space 15. If the angle a is less than 30°, the air which flows through aspiration channel 10 along the guide fin 1*a* will collide with the wall of aspiration chamber 3, and the turbulence which occurs when it bounces off the wall will cause problems. For this reason we have stipulated that the angle $\alpha$ should be between 20 and 40°, and ideally in the vicinity of 30°.

The negative pressure at outlet end 1*d*1 of the sheet guide space 15 also has the effect of preventing eddies from forming. The boundary layer on the surface of sheet 11 formed by the air stream in the sheet guide space 15 will be thinner, so that when a thinner sheet is being printed, the sheet 11 will be drawn more easily toward surface 1*d* of the sheet guide unit, thus preventing it from flapping or fluttering.

In the second preferred embodiment, which is pictured in FIG. 2, the guide fin has a curved cross section, forming a guide fin 1*a* which gradually curves around into the aspiration chamber 3. The upper wall 1*c* which along with the guide fin 1*a* forms the inlet (aspiration channel 10) of the aspiration chamber 3 is also curved so as to correspond to the shape of the guide fin 1*a*.

With this embodiment, in addition to being affected by the negative pressure at outlet end 1*d*1 of the sheet guide unit, the air stream which passes through sheet guide space 15 is made to flow smoothly along the curved surface of guide fin 1*a*. Burbles are less likely to form in the channel, and laminar flow is enhanced in sheet guide space 15.

In the third embodiment pictured in FIGS. 3 and 4, a recirculation path is provided which goes from the aspiration chamber 3 via exhaust pipe 5 and supply pipe 6 back to air supply chamber 2. A recirculation pump 13 is installed on the recirculation path 8, and an escape valve 14, through which a portion of the air propelled by the pump can escape, is provided somewhere between the propulsion side of the recirculation pump 13 and air supply chamber 2.

From fundamental data achieved by the study of turbulence in the field of fluid mechanics, we know that if we assume that disturbance factors which affect the flow from a pump which drives a fluid in a channel are equal, of the two alternative designs for the system, namely a closed loop in which the flow recirculates and an open loop in which it does not, the closed loop design is more effective at reducing the turbulent component of the flow. This design also requires less energy to drive the flow.

With this third embodiment, then, the air which is made to flow through the sheet guide space 15 is continuously recirculated via the recirculation path 8. This produces a smoother flow and makes turbulence less likely to develop. And since it requires only a single recirculation pump 13, this scheme reduces the cost of equipment.

In this third embodiment, an escape valve 14 is provided on the outlet side of air recirculation pump 13. This insures that the volume of air exhausted from the aspiration chamber 3 will be greater than the volume supplied to chamber 2 via supply pipe 6. It enables the air to be drawn into the aspiration chamber 3 smoothly and helps achieve the negative pressure effect at the outlet of the sheet guide unit. By adjusting the opening of the escape valve 14, we can easily adjust how much air is pushed out of chamber 2 and how much is sucked into chamber 3. We can thus easily adjust the magnitude of the Bernoulli effect and achieve an appropriate negative pressure on the sides of the sheet guide unit 1. Eddies will not form over the guide fin 1*a*, and a smooth laminar flow will be created through the entire length of the sheet guide space 15. The boundary layer between the guide surface and the surface of sheet 11 which is produced by the air stream will be thinner, and the sheet 11 will be less likely to buckle or flutter. Even if a skeleton cylinder is used as intermediate cylinder 27, a sheet of thinner stock can be conveyed smoothly without flapping or fluttering.

In the embodiment, the sheet guide unit is installed on intermediate cylinder 27. The invention may also be implemented as a sheet guide unit for intermediate cylinder 121*b*, the delivery cylinder or the printing cylinder.

As has been discussed, with this invention, a stable air flow is produced with little turbulence on the sides of the sheet guide unit. The air stream produces a thinner turbulent boundary layer on the surface of the sheet, so there is less tendency for the sheet to flap or flutter. The sheet can travel smoothly through the sheet guide space. The air is prevented from colliding with the frame of the press, and the turbulence which would result in the press mechanism is eliminated.

Even when a skeleton cylinder is used, sheets of thinner stocks will not experience flapping and buckling, but will be conveyed smoothly through the sheet guide space. Thus this scheme enables us to use any thickness of paper in a press with a skeleton cylinder.

What is claimed is:

1. A sheet guide unit provided for a sheet-fed press which prevents a sheet from flapping or fluttering, which is provided under an intermediate cylinder or a delivery cylinder, and separated from the cylinders by a small sheet guide space for guiding the sheet, comprising:

a curved sheet guide surface with which the lower surface of the cylinder creates the small sheet guide space, the space through which the air stream is directed;

an air supply chamber which is behind said sheet guide surface;

a plurality of air vents which vent air from said air supply chambers into the small sheet guide space, said air vents facing away from each other toward the sides of the cylinder on either side of its center line which vent air along the surface of said curved sheet guide surface along the width of the cylinder, thereby the difference in the velocity of the air flow above and below the sheet being conveyed causes the sheet to be drawn toward said curved sheet guide surface and suspended slightly above said curved sheet guide surface as the sheet is conveyed;

a pair of air aspiration chambers provided adjacent to said air supply chamber on the outer sides of the cylinder into which the air is aspirated; and an air guide fin which is an outer extended portion of said curved sheet guide surface into said air aspiration chamber, and serves for directing the air into said air aspiration chamber;

wherein the volume of air drawn out from said air aspiration chambers on either side of the cylinder is larger than the volume of air aspirated into said air aspiration chambers, thereby a negative pressure in the vicinity of the both ends of the sheet guide surface is created for preventing the air streams exiting from both ends of the sheet guide surface from colliding with the frame and causing turbulence.

2. A sheet guide unit according to claim 1, wherein said air guide fin is straight, and said straight air guide fin has a downward angle $\alpha$ of 20 to 40° with respect to said sheet guide surface.

3. A sheet guide unit according to claim 1, wherein said air guide fin is curved into said air aspiration chamber.

4. A sheet guide unit according to claim 1, wherein an exhaust pump is connected to said air aspiration chamber, and a supply pump is connected to said air supply chamber respectively, and the capacity of said exhaust pump is greater than the capacity of said supply pump.

5. A sheet guide unit according to claim 1, further comprising an escape valve and a recirculation pump in a recirculation path between said air aspiration and supply chambers in order to allow a portion of the air to escape from said escape valve in said recirculation path.

6. A sheet guide unit provided for a sheet-fed press which prevents a sheet from flapping or fluttering, and allows a sheet of thinner paper to be conveyed smoothly even when a skeleton cylinder is used, which is better suited for thicker papers, which is provided under an intermediate cylinder or a delivery cylinder, and separated from the cylinders by a small sheet guide space for guiding the sheet, comprising:

a curved sheet guide surface with which the lower surface of the cylinder creates the small sheet guide space, the space through which the air stream is directed;

an air supply chamber which is behind said sheet guide surface;

a plurality of air vents which vent air from said air supply chambers into the small sheet guide space, said air vents facing away from each other toward the sides of the cylinder on either side of its center line which vent air along the surface of said curved sheet guide surface along the width of the cylinder, thereby the difference in the velocity of the air flow above and below the sheet being conveyed causes the sheet to be drawn toward said curved sheet guide surface and suspended slightly above said curved sheet guide surface as the sheet is conveyed;

a pair of air aspiration chambers provided adjacent to said air supply chamber on the outer sides of the cylinder into which the air is aspirated; and an air guide fin which is an outer extended portion of said curved sheet guide surface into said air aspiration chamber, and serves for directing the air into said air aspiration chamber;

wherein the volume of air drawn out from said air aspiration chambers on either side of the cylinder is larger than the volume of air aspirated into said air aspiration chambers, thereby a negative pressure in the vicinity of the both ends of the sheet guide surface is created for preventing the air streams exiting from both ends of the sheet guide surface from colliding with the frame and causing turbulence.

* * * * *